United States Patent [19]

Fujisawa et al.

[11] Patent Number: 5,037,697

[45] Date of Patent: Aug. 6, 1991

[54] CARBON FIBER AND PROCESS FOR PRODUCING THE SAME

[75] Inventors: Eiji Fujisawa; Tadanori Kitamura, both of Fukushima, Japan

[73] Assignees: Nitto Boseki Co., Ltd., Fukushima; Kawasaki Steel Corporation, Kobe, both of Japan

[21] Appl. No.: 234,164

[22] Filed: Aug. 19, 1988

Related U.S. Application Data

[62] Division of Ser. No. 5,918, Jan. 21, 1987, abandoned.

[51] Int. Cl.[5] ..... C10C 3/10; C08L 95/00; D01F 8/18; D01F 9/15; D01F 9/155

[52] U.S. Cl. ..... 428/373; 208/23; 208/39; 264/29.2; 264/211; 264/211.11; 423/447.2; 423/447.4; 423/447.6

[58] Field of Search ..... 208/23, 39; 264/211, 264/211.11; 428/373

[56] References Cited

U.S. PATENT DOCUMENTS

| | | | |
|---|---|---|---|
| 4,005,183 | 1/1977 | Singer . | |
| 4,470,960 | 9/1984 | Uemura et al. | 423/447.1 |
| 4,590,055 | 5/1986 | Yamada et al. | 423/447.4 |
| 4,861,653 | 8/1989 | Parrish | 428/288 |

FOREIGN PATENT DOCUMENTS 168639 1/1986 European Pat. Off. .

*Primary Examiner*—James C. Cannon
*Attorney, Agent, or Firm*—Wegner, Cantor, Mueller & Player

[57] ABSTRACT

The present invention relates to a carbon fiber having a novel structure in which the outer circumferential part of fiber section is constituted of an optically isotropic component and its central part is constituted of an optically anisotropic component or an optically anisotropic component partially containing optically isotropic component, which the carbon fiber shows no cracks at all, as well as to a process for producing said carbon fiber.

3 Claims, 1 Drawing Sheet

CARBON FIBER AND PROCESS FOR PRODUCING THE SAME

This application is a divisional of Ser. No. 005,918, filed Jan. 21, 1987, now abandoned.

BACKGROUND OF THE INVENTION 1. Field of the Invention

The present invention relates to a carbon fiber having a structure that the outer peripheral region of the fiber cross section is composed of an optically isotropic component and its central region is composed of an optically anisotropic component or an optically anisotropic component partially containing optically isotropic component, which the fiber surface shows no cracks at all, and a process for producing the same.

Carbon fibers are widely in use in the field of special structural parts in space industry and aircraft industry and in the field of leisure articles and sport articles. 2. Brief Description of the Prior Art Generally saying, carbon fibers are roughly classified into general-purpose carbon fibers and high-performance carbon fibers according to their mechanical properties.

The high-performance carbon fibers are further classified according to their starting material into those using synthetic fiber such as polyacrylonitrile and the like as starting material and those using petroleum pitch and coal tar pitch as starting material.

When a synthetic fiber such as polyacrylonitrile is used as starting material, the cost of product is unavoidably high due to the high price of starting synthetic fiber and the low carbonization yield from the starting fiber, and this high cost has made the most important cause obstructing the growth of this type of carbon fibers as general industrial materials.

In such a state of things, the process for producing high-performance carbon fiber at a low cost by using the optically anisotropic mesophase pitch as starting material is being studied. (If a substance having polynuclear polycyclic molecule such as pitch is made to grow by heat treatment, the whole or a part of the pitch becomes exhibiting a state of liquid crystal. Such a liquid state is called "carbonaceous mesophase" or simply "mesophase". A pitch containing such mesophase is called "mesophase pitch". It is anisotropic optically.)

Regarding the content of mesophase in mesophase pitch, it is mentioned to be 40 -90% or 70% by weight or more in Japanese Patent Publication No. 37,611/80 and Japanese Patent Publication No. 51,526/83 (corresponding to U.S. Pat. No. 4,301,135). We may consider that the term "mesophase pitch" inclusively means the pitches containing mesophase in these amounts.

According to the prior techniques, a carbon fiber prepared by spinning such a mesophase pitch at a low temperature (300 to 350° C.) has had a fault that cracks formed on the surface of fiber greatly deteriorate the performances of carbon fiber.

The mesophase, i.e. the, anisotropic component of pitch, is oriented in the direction of fiber axis at the time of melt spinning. It is known that the texture of fiber section perpendicular to fiber axis is classified into three types according to direction of the orientation.

Said three types are "radial structure" perpendicular to fiber axis, "onion structure" constituted of concentric orientation and "random structure" constituted of irregular orientation. Hitherto, these structures have been considered dependent on spinning temperature. In other words, it is considered that the structure changes from radial to random and further to onion as the spinning temperature rises. In FIG. 1, (1-1) denotes radial structure having cracks on fiber surface; (1-1) expresses random structure, and (1-3) does onion structure.

Since a fiber of radial structure readily cracks at the fiber surface, such a fiber is disadvantageous as a general industrial material. Further, since such a crack brings about a decrease in strength, radial structure is considered undesirable. Thus, a number of proposals have hitherto been made about the technique for producing carbon fibers having random or onion structure not forming cracks on fiber surface, and more particularly the technique for spinning such carbon fibers.

These proposals can be roughly classified into the following two methods:

(1) A method for obtaining carbon fiber having random or onion structure by employing a high spinning temperature.

(2) A method for obtaining carbon fiber having random or onion structure by controlling the flow of molten pitch passing the spinning nozzle.

As one example of Method (1), Japanese Patent Kokai (Laid-Open) No. 76,925/84 (corresponding to G.B. 2,131,781) can be referred to. According to this process, the phase states of anisotropic component and isotropic component at the spinning temperature are regarded as the factor determining the structure of fiber, and carbon fiber having random or onion structure is produced by carrying out the spinning at a temperature at which matrix becomes isotropic (the term "matrix" means the phase playing the role of parent phase in a two phase mixture consisting of isotropic component and mesophase.). Another process belonging to Method (1) is disclosed in Japanese Patent Kokai (Laid-Open) No. 53,717/84 (corresponding to U.S. Pat. No. 4,590,055 combining with Japanese Patent Kokai Nos. 36,724/84, 36,725/84, 36,726/84 and 53,717/84) according to which a carbon fiber having a structure free from cracks formation on its fiber surface is obtained by heating the starting pitch to a temperature higher than its viscosity-change temperature and thereafter spinning it.

However, all these processes cannot be said to be desirable from the viewpoint of stability of spinning process because of high spinning temperature which causes formation of bubbles in molten pitch. Thus, the bubbles cause breakage of fiber at the time of spinning, and the bubbles are sometimes taken into fiber. Further, these processes cannot be applied to the spinning of multi-filament, filament, because melt viscosity is low in these processes.

On the other hand, as example of Method (2), the processes of Japanese Patent Kokai (Laid-Open) No. 168,124/84, Japanese Patent Kokai (Laid-Open) No. 168,127/84 (corresponding to W.O. 8,403,722), etc. can be referred to. According to these processes, the flow of anisotropic pitch is controlled so as to form a carbon fiber of random structure or onion structure by varying the shape of nozzle. However, these processes can exhibit their effect only when the molten pitch has a good flowability, and therefore a high spinning temperature is similarly necessary substantially, due to which bubble formation of molten pitch and contamination of bubbles into fiber are unavoidable. Further, these processes have another disadvantage that the nozzle for these processes is difficult to produce.

As above, all the prior processes for producing carbon fiber having a structure free from the formation of cracks on its fiber surface have been based on a mechanical control of the flow of molten pitch passing through nozzle by some means such as lowering the melt viscosity of pitch, altering the shape of nozzle, or the like. As the result, these processes can exhibit their effect only at a high spinning temperature. In other words, in all these processes, the spinning is carried out in a temperature region at which molten pitch is thermally instable. Accordingly, the resulting fiber is broken due to bubbles at the time of spinning or contains bubbles, and the processes are unsatisfactory and unable to produce a high performance carbon fiber stably on an industrial scale.

SUMMARY OF THE INVENTION

The object of the present invention consists in a high-performance carbon fiber having a structure free from cracks formation on its surface, as well as to a process for producing said carbon fiber with a high spinning efficiency at a relatively low temperature at which molten pitch is thermally stable and a high spinning stability.

The present invention provides a carbon fiber wherein an optically isotropic component is formed on the surface of the carbon fiber due to which the surface is prevented from having a radial structure and the fiber surface shows no cracks at all; wherein the central part is constituted of an optically anisotropic component or an optically anisotropic component partially containing optically isotropic component and the thickness of fiber surface layer constituted of optically isotropic component can be varied arbitrarily; and wherein the surface of carbon fiber structure is constituted of an optically isotropic component and its central part is constituted of an optically anisotropic component or an optically anisotropic component partially containing optically isotropic component.

Further, the present invention relates also to a process for producing a carbon fiber which comprises a step for melt-spinning an optically anisotropic pitch prepared from coal tar pitch, a step for infusibilizing the resulting pitch fiber, a step for carbonizing the pitch fiber and a step for graphitizing the pitch fiber.

DETAILED DESCRIPTION OF THE INVENTION

More particularly, the present invention relates to a process for producing the above-mentioned carbon fiber which comprises a step for controlling a pitch, a step for melt-spinning the pitch, a step for infusibilizing the resulting pitch fiber, a step for carbonizing the pitch fiber and a step for graphitizing the pitch fiber, characterized in that the spinning pitch shows a bulk mesophase and contains 60 to 95% by volume of mesophase and 80 to 95% by weight of benzene-insoluble fraction; that, in the step of adding a freshly prepared optically isotropic pitch to optically anisotropic pitch and thereby controlling the contents of mesophase and benzene-insoluble fraction in order to prevent the formation of cracks on the surface of pitch fiber in the process of carbonizing and graphitizing pitch fiber, the proportion of the optically isotropic pitch to the optically anisotropic pitch is varied, owing to which the melt-spinning can be carried out at a relatively low temperature; that the melt-spinning is carried out so as to form the surface of pitch fiber from the optically isotropic pitch, owing to which no cracks are formed at all on the surface of pitch fiber in the process of carbonization and graphitization and hence the resulting carbon fiber shows no cracks at all; and that, in the section of the carbon fiber thickness of the optically isotropic component layer forming the outer circumference of the carbon fiber can be varied.

As one embodiment of the above-mentioned production process, a process for producing a carbon fiber which comprises using a spinning pitch prepared by adding, in the pitch-controlling step, an optically isotropic pitch prepared by distilling coal tar pitch, petroleum pitch, SRC and the like under reduced pressure or extracting them with a solvent and having a softening point of 150° C. or above and a benzene-insoluble fraction content of 30% by weight or more to an optically anisotropic pitch is also included in the invention.

Owing to adoption of the above-mentioned construction, the present invention has for the first time made it possible to obtain, stably and on an industrial scale, a high-performance carbon fiber having a structure free from cracks on its fiber surface even in the form of a multi-filament of 200 holes or above.

As used in the invention, the term "optically anisotropic component" means the area looking gleaming when the pitch surface is ground and observed by means of reflection type of polarization microscope with rectangularly polarized light or the area showing a different color when sensitive color plate is used.

As the starting material used for the production of such anisotropic pitch, any of the tars and pitches appearing in the bottom oils when coal type heavy oils, such as coal tar pitch, coal hydrogenation product and the like, or petroleums are distilled under ordinary or reduced pressure, as well as the tars and pitches formed by the heat treatment of these bottom oils, can be used. Among them, coal tar pitch is particularly preferable because it is easy to treat and gives a good anisotropic pitch.

As the process for producing anisotropic pitch from coal tar pitch, a number of processes have already been disclosed. For example, it can be produced according to the processes of Japanese Patent Kokai (Laid-Open) No. 19,127/74 (corresponding to U.S. Pat. No. 4,005,183), Japanese Patent Kokai (Laid-Open) No. 36,725/84 (corresponding to U.S. Pat. No. 4,590,005), etc. In the present invention, such well known anisotropic pitches can be used. That is, an anisotropic pitch can be produced by hydrogenating a coal tar pitch in the presence of a hydrogen-donating solvent such as tetrahydroquinoline or tetralin under a spontaneously developing pressure at a temperature of 350° C. to 500° C. or, otherwise, hydrogenating coal tar pitch together with an aromatic oil under an elevated pressure of hydrogen, followed by recovering the solvent and then subjecting the hydrogenated tar to a mesophase-forming treatment at a temperature of 400° C. to 500° C. in an atmosphere of inert gas at ordinary or reduced pressure.

The anisotropic pitch prepared by the mesophase-forming treatment usually contains 95% by volume or more of mesophase. Particularly, as the spinning pitch for the production of high-performance carbon fiber, those showing a whole anisotropy under polarization microscope have hitherto been used. It is well known that, if a pitch showing a whole anisotropy is spun in the thermally stable temperature region of pitch, a fiber of radial structure having cracks on its fiber surface is obtained.

In the invention, it is indispensably necessary that the spinning pitch has a mesophase content of 60 to 95% by volume, preferably 80 to 90% by volume, and a benzene-insoluble fraction content of 80 to 95% by weight, preferably 80 to 90% by weight, and, when a block of this pitch is observed under polarization microscope, the matrix shows a bulk mesophase. (The term "bulk mesophase" means a state that mesophase spherulites join together and grow up until they form a matrix. In this state, isotropic component is distributed "island"-wise.)

The contents of mesophase and benzene-insoluble fraction are controlled by adding a freshly prepared optically isotropic pitch to an optically anisotropic pitch prepared by the above-mentioned mesophase-forming treatment which contains 95% by volume or more of mesophase and preferably shows a whole anisotropy when observed under polarization microscope.

In the invention, a particularly high effect can be achieved if the anisotropic pitch is adjusted to a mesophase content of 60 to 95% by volume, preferably 80 to 90% by volume, and a benzene-insoluble fraction content of 80 to 95% by weight, preferably 80 to 90% by weight, by the addition of optically isotropic pitch and then put to use as a spinning pitch. If the content of mesophase is not more than 60% by volume, the anisotropic component of pitch shows spherulite under polarization microscope and its phase separation from the isotropic component of matrix occurs at the time of spinning, so that the spinning process becomes instable. If the content of mesophase exceeds 95% by volume, such a pitch resembles the anisotropic pitch subjected to the mesophase-forming treatment in properties, so that the invention brings about no particular effect.

As the optically isotropic pitch, any of coal tar pitch, petroleum pitch and SRC may be used. For achieving the effect of the invention, a pitch having a benzene-insoluble fraction content of 30% by weight or more and a softening point of 150° C. or above which has been prepared by subjecting these pitches to a distillation under reduced pressure or to a solvent extraction and then heat treating it at a temperature of 450° C. or below, preferably 400° C. or below and more preferably 320° C. to 380° C. for a period of 180 minutes or shorter and preferably 30 minutes or shorter is preferred. Such a pitch is added in such an amount that the matrix shows a bulk mesophase as measured with polarization microscope, namely in such an amount that the content of optical mesophase falls in the range from 60% to 95% by volume. In adding and mixing the optically isotropic pitch, it is mixed with optically anisotropic pitch and pulverized at room temperature,. Otherwise, a mixture consisting of their blocks is melted and homogenized at a temperature ranging from 300° C. to 370° C.

The spinning pitch thus obtained is then subjected to a melt spinning. As used in the invention, the term "melt spinning" means the process conventionally employed for producing carbon fiber from pitches.

That is, a spinning pitch is melted at a temperature of 300° C. to 400° C., and then the molten pitch is extruded from nozzle by the pressure of inert gas or by the pushing force of measuring pump to spin a yarn. If the spinning temperature is so high as to cause thermal decomposition of pitch, the generated gas forms bubbles and causes breakage of yarn at the time of spinning. Accordingly, a temperature ranging from 300° C. to 380° C. is adopted as the spinning temperature. The pitch extruded out of the nozzle is spun at a high speed of 200 m/minute or above, preferably 400 m/minute or above. The fiber diameter of the fiber can easily be controlled by varying the flow rate of pitch and the spinning speed. According to the invention, multi-filaments of 200 holes or above can also be spun.

The pitch fiber thus spun is then subjected to an infusibilizing treatment. This is carried out by heating the pitch fiber in an oxidative atmosphere of air, oxygen, ozone, nitrogen oxide or the like at a heating rate of 10° C./minute or below, preferably 2° to 5° C./minutes, up to a temperature of 200° C. to 380° C., preferably 240° C. to 350° C., and then maintaining the pitch fiber at this temperature for a period of 30 minutes or shorter, preferably 1–30 minutes. If the temperature of infusibilization is not higher than 200° C., the infusibilization does not progress sufficiently, which makes a cause of softening or sticking in the subsequent carbonizing step and therefore a good carbon fiber cannot be obtained. If the temperature of infusibilization is not lower than 380° C. of the period of time during which the pitch fiber is maintained at that temperature is longer than 300 minutes, fiber is in an excessively oxidative state and no carbon fiber having a high strength can be obtained. If the heating rate in the infusibilizing step is not less than 10° C./minute, sticking occurs between fibers and no good carbon fiber can be obtained.

The fiber which has been subjected to infusibilization is then subjected to carbonizing treatment in an atmosphere of inert gas. This carbonizing treatment is carried out by heating the pitch fiber up to a temperature of 800° C. or above, preferably 1,000° to 1,500° C., at a heating rate of 30° C./minute or below and preferably 15° C./minute or below and then maintaining the fiber at this temperature for 5 minutes or longer, preferably 10 to 30 minutes. If the temperature of carbonization is not higher than 800° C., the carbonization of fiber does not progress sufficiently, and the performances of high-performance carbon fiber are not manifested. If the heating rate is greater than 30° C./minute, sticking occurs between fibers and no good carbon fiber is obtained.

The fiber which has been subjected to the carbonizing treatment may be then subjected to graphitizing treatment, if it is desired. The graphitization is carried out by heating the fiber to a temperature of from 1,800° to 3,000° C. in an atmosphere of inert gas.

In the invention, a high-performance carbon fiber having a structure free from cracks formation on its fiber surface can be obtained only via the above-mentioned construction. Although its reason has not yet been elucidated fully, it is probably for the reason that the optically isotropic component in the spinning pitch exercises a certain action upon the mesophase layer surface oriented in the direction of fiber axis. It is also assumable that the addition of isotropic component promotes the formation of a flat layer on the superficial layer of fiber cross section and this flat layer suppresses the crack formation on the surface, as shown in FIGS. 2 and 3.

BRIEF DESCRIPTION OF THE DRAWINGS

FIG. 3 illustrates a structure in which the central part has an obscure radial structure and the superficial colored layer expresses a flat layer.

Figure 1:
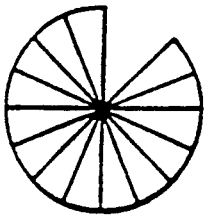
FIG. 1 is an outlined view of typical fiber section structure in prior coal tar pitch type HP carbon fiber, wherein (1-1) denotes radial structure, (1-2) denotes random structure and (1-3) denotes onion structure.
Figures 1, 2:
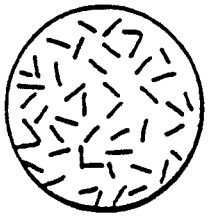
FIG. 2 and FIG. 3 illustrate the fiber section structures of carbon fibers obtained according to the invention, wherein FIG. 2 expresses an obscure radial structure

Next, the invention will be illustrated in more detail with reference to examples.

Various measurements in the examples were performed in the following manner.

Content of Optically Anisotropic Component (Mesophase Content)

Sample is previously placed in a cylindrical aluminum cell having known dimensions and melted in the atmosphere of nitrogen at 370° C. and then rapidly cooled and solidified. This sample is embedded in an epoxy resin together with the aluminum cell, and then the cylindrical aluminum cell is cut in the direction of the diameter. After grinding the cut sample, the amount of optically anisotropic component in the cylinder section is measured in the term of area by means of polarization microscope. Then, the area is converted to volume and the content of anisotropic component is calculated from the volume ratio between anisotropic component and isotropic component.

Strength

It is measured according to the method prescribed in JIS-R-7601. Diameter of fiber is measured at the position adjacent to the strength measurement part, by the use of micro gage.

Softening Point It is measured by the use of Softening Point Measuring Apparatus Model AMK, manufactured by Asia Rikagaku Kikai.

EXAMPLE 1

In an autoclave, 1 part by weight of a commercial coal tar pitch having a benzene-insoluble fraction content of 30.7% by weight, a softening point of 88.8° C. and a fixed carbon content of 56.4% by weight was hydrogenated in the presence of 2 parts by weight of tetralin under a spontaneously developing pressure of nitrogen gas atmosphere at 430° C. for 30 minutes. After removing the tetralin-insoluble fraction including free carbon, the solvent was recovered to obtain a hydrogenated pitch. Then, the hydrogenated pitch was subjected to mesophase-forming treatment while heating it up to 490° C. at a heating rate of 3° C./minute under a reduced pressure of 6 Torr, while blowing nitrogen gas. Thus, a treated pitch was obtained.

A block of this pitch was examined by means of polarization microscope to reveal that it was wholly anisotropic. The wholly anisotropic pitch thus obtained had a quinoline-insoluble fraction content of 33.5% by weight, a benzene-insoluble fraction content of 91.3% by weight and a softening point of 276° C.

To this anisotropic pitch was added 19.1% by weight of an isotropic pitch having a benzene-insoluble fraction content of 56.9% and a softening point of 231° C., and the mixture was melted and homogenized 370° C. in an atmosphere of nitrogen to obtain a spinning pitch. The spinning pitch had a benzene-insoluble fraction content of 85.2% by weight and a softening point of 271° C. A block of this pitch was examined by means of polarization microscope to reveal that the matrix was constituted of bulk mesophase and the isotropic part was distributed "island"-wise and the mesophase content was about 85% by volume.

This spinning pitch was melted in a spinning apparatus made of brass having a nozzle diameter of 0.2 mm, and it was spun by the pressure of nitrogen gas at a pitch temperature of 340° C. The formed pitch fiber was wound on a flat drum at a speed of 400 m/minute to obtain a breakage-free fiber having a fiber daimeter of 10.5μ.

Then, the pitch fiber was heated to 350° C. under a stream of oxygen and maintained at this temperature for 10 minutes to complete infusibilization. The infusibilized fiber thus obtained was further heated up to 1,100° C. at a heating rate of 15° C./minute under a stream of argon and thereafter maintained at this temperature for 30 minutes to obtain a carbon fiber.

In this carbon fiber, the surface layer was constituted of a flat optically isotropic component layer, and the central part was constituted of a component showing an obscure radial structure, and the surface component had a thickness of 10% based on the fiber radius. This carbon fiber having such a double-layer structure was completely free from cracks on its surface. Its tensile strength was 250 kg/mm$^2$ and its elastic modulus was 14.0 ton/mm$^2$.

Comparative Example 1

Without adding isotropic pitch, the wholly anisotropic pitch obtained in Example 1 was directly spun at 340° C. in the same manner as in Example 1. As the result, a fiber having a diameter of 11.0μ was obtained without any breakage, until the pitch had been exhausted.

The pitch fiber was infusibilized and carbonized in the same manner as in Example 1 to obtain a carbon fiber. This carbon fiber had a tensile strength of 150 kg/mm$^2$ and an elastic modulus of 15.0 ton/mm$^2$. By examining its fiber section by means of scanning electron microscope, it was revealed that the section showed a typical radial structure with noticeable cracks on fiber surface. Due to the cracks on the fiber surface the carbon fiber showed a low tensile strength.

Comparative Example 2

To the wholly anisotropic pitch obtained in Example 1 was added 28.2% by weight of the same isotropic pitch as used in Example 1. The mixture was melted and homogenized to obtain a spinning pitch.

The spinning pitch thus obtained had a benzene-insoluble fraction content of 81.7% by weight and a softening point of 266° C. By examining its block by means of polarization microscope, a phase-phase conversion was revealed. That is, the isotropic component constituted the matrix and the mesophase formed spherulites. Its mesophase content was 75% by volume.

When this spinning pitch was spun in the same manner as in Example 1, a fiber having a diameter of 10.0μ was obtained at a spinning temperature of 340° C. However, breakage of fiber took place 10 minutes after starting the spinning, and thereafter breakage of fiber was repeated many times.

Figures 1, 2, 3:
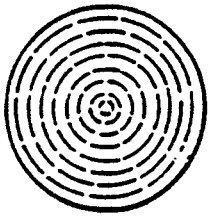
Figure 2:
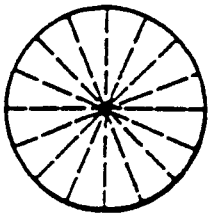
Figure 3:
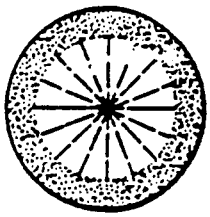

The pitch fiber thus obtained was infusibilized and carbonized in the same manner as in Example 1 to obtain a carbon fiber. This carbon fiber had a tensile strength of 185 kg/mm$^2$ and an elastic modulus of 12.0 ton/mm$^2$. Examination of fiber cross section by means of scanning electron microscope revealed that, as shown in FIG. 3, the central part somewhat showed an obscure radial structure to a slight extent, and the surface layer constituted a flat layer having so great a thickness as 30% of fiber radius.

Example 2

An anisotropic pitch was prepared by subjecting the hydrogeneated pitch obtained in Example 1 to a mesophase-forming treatment by heating it under a reduced pressure of 6 Torr at a heating rate of 3° C./minute up to 470° C. while blowing nitrogen gas and thereafter maintaining it at this temperature for 20 minutes.

The anisotropic pitch thus obtained had a quinoline-insoluble fraction content of 33.0% by weight, a benzene-insoluble fraction content of 91.8% by weight and a softening point of 268° C. As measured by means of polarization microscope, block of this anisotropic pitch showed a whole anisotropy.

To this anisotropic pitch was added 20.0% by weight of an isotropic pitch having a benzene-insoluble fraction content of 54.9% by weight and a softening point of 223° C., and the mixture was melted and homogenized in an atmosphere of nitrogen at 370° C. to prepare a spinning pitch. This spinning pitch had a benzene-insoluble fraction content of 84.8% by weight and a softening point of 263° C. Examination of a block of this pitch by means of polarization microscope revealed that the matrix was a bulk mesophase and the isotropic part was distributed "island"-wise and the content of mesophase was about 80% by volume.

This spinning pitch was melted in a spinning apparatus made of brass having cylindrically arranged 200 holes having a nozzle diameter of 0.2 mm, and it was spun by the pressure of nitrogen gas at a pitch temperature of 345° C. The pitch fiber was wound on a flat drum at a speed of 450 m/minute to obtain a fiber having a fiber diameter of 9.2μ.

Then, the pitch fiber thus obtained was infusibilized and carbonized in the same manner as in Example 1 to obtain a carbon fiber.

The carbon fiber thus obtained was just the same as that of Example 1 in structure. Its tensile strength was 220 kg/mm$^2$ and its elastic modulus was 13.7 ton/mm$^2$. Examination of this carbon fiber by means of scanning electron microscope revealed that no cracks existed at all in the structure layer constituted of optically isotropic component.

Comparative Example 3

Into 1 part by weight of a commercial coal tar pitch having a benzene-insoluble fraction content of 30.7% by weight, a softening point of 88.8° C. and a fixed carbon content of 56.4% by weight was mixed 2 parts by weight of anthracene oil. After removing the solvent-insoluble matter, the solvent was recovered. The residual pitch was heated up to 380° C. at a heating rate of 3° C./minute at ordinary pressure while blowing nitrogen gas and then maintained at this temperature for 15 minutes to complete the heat treatment. The pitch thus obtained had a benzene-insoluble fraction content of 56.9% by weight and a softening point of 231° C. Examination of a block of the pitch thus obtained by means of polarization microscope revealed that it was wholly constituted of isotropic component.

Then, this pitch was spun at 300° C. by the use of the same spinning appqratus as used in Example 1. The 400 m/minute to obtain a fiber of 9.8μ. Then, the pitch fiber was heated up to 350° C. at a heating rate of 1° C./minute under a stream of oxygen and thereafter maintained at this temperature for 10 minutes to complete the infusibilization. The infusibilized fiber thus obtained was further heated up to 1,100° C. at a heating rate of 15° C./minute under a stream of argon and maintained at this temperature for 30 minutes to obtain a carbon fiber. The carbon fiber thus obtained had a tensile strength of 95 kg/mm$^2$ and an elastic modulus of 5.3 ton/mm$^2$. Examination of its fiber section by means of scanning electron microscope revealed that the fiber section was quite flat and smooth and no cracks were noticeable on the fiber surface.

Comparative Example 4

The hydrogenated pitch obtained in Example 1 was subjected to a mesophase-forming treatment by heating it up to 480° C. at a heating rate of 3° C./minute under ordinary pressure while blowing nitrogen gas, then immediately cooling it to 420° C. and thereafter maintaining it at this temperature for 80 minutes.

The pitch thus obtained had a quinoline-insoluble fraction content of 24.0% by weight, a benzene-insoluble fraction content of 84.9% by weight and a softening point of 262° C. Examination of a block of this pitch by means of polarization microscope revealed that the matrix was constituted of mesophase and the isotropic component was distributed "island"-wise. Its mesophase content was about 85% by volume.

Then, this pitch was spun in the same manner as in Example 1 to obtain a pitch fiber having a diameter of 10.9μ. The pitch fiber was infusibilized and carbonized in the same manner as in Example 1 to obtain a carbon fiber. This carbon fiber had a tensile strength of 190 kg/mm$^2$ and an elastic modulus of 17.2 ton/mm$^2$. Examination of its fiber section by means of scanning electron microscope revealed that it showed a typical radial structure with noticeable formation of cracks on its fiber surface.

According to the process of the invention an optically isotropic pitch is added and mixed into an optically anisotropic pitch in the pitch-controlling step, owing to which the carbon fiber of the invention has a double-layer structure wherein the surface layer is constituted of an optically isotropic component and the central part is constituted of an optically anisotropic component. Since the surface layer is constituted of an optically isotropic component, it is possible to make the fiber surface entirely free from cracks making the cause of the drop in tensile strength of carbon fiber. Thus, the carbon fiber of the present invention perfectly free from cracks on its fiber surface has a tensile strength of 200 to 250 kg/mm$^2$. This value of tensile strength is about 30 to 50% greater than the tensile strength of prior carbon fibers (150 to 160 kg/mm$^2$) having cracks on their fiber surface.

According to prior production processes of carbon fiber having no cracks on its fiber surface, it was unavoidably necessary to expose spinning pitch to a relatively high melt spinning temperature, as the result of which the molten pitch formed bubbles and was decomposed. This phenomenon caused the breakage of pitch fiber in the course of melt spinning, and the bubbles formed in the molten pitch taken into fiber obstructed a stable practice of spinning. Accordingly, it was nearly impossible to spin a pitch fiber by the use of a nozzle having many holes. On the contrary, in a melt spinning process using the pitch of the invention, a spinning temperature higher than 360° C. at which the spun pitch shows a thermally instable state can be avoided. If a usual pitch is spun at a temperature not higher than 360° C., the resulting pitch fiber has a radial structure almost wholly and therefore naturally has cracks on its fiber surface. According to the pitch-controlling process of the present invention, contrariwise, the melt spinning can be practiced at a relatively low temperature so that the molten pitch undergoes no bubble formation at all. Accordingly, the breakage of fiber due to quality change of pitch does not occur at all in the course of spinning, which much facilitates the multi-hole spinning of pitch fiber. Further, according to the pitch-controlling method of the invention, optically isotropic pitch exhibits a thixotropic character owing to the spinning tension applied at the time of melt spinning. Therefore, when the molten pitch forms a cone, the optically isotropic pitch moves toward the cone surface, as the result of which the surface of pitch fiber is covered by a layer of the optically isotropic pitch. Thus, a carbon fiber entirely free from cracks on its fiber surface can be produced even at a relatively low temperature.

What is claimed is:

1. A pitch fiber made by a process comprising the steps of (a) mixing at a temperature of 300°-370° C. optically isotropic pitch having a softening point of at least 150° C. and a benzene insoluble fraction of at least 30% by weight with optically anisotropic pitch having a mesophase content of at least 95% by volume to obtain a pitch composition having a bulk mesophase content between 80-95% by volume and a benzene insoluble fraction between 80-95% by weight, and (b) melt-spinning the pitch composition at a maximum temperature of 360° C.

2. A pitch fiber having an outer circumferential part consisting essentially of optically isotropic pitch having a benzene insoluble fraction of at least 30% and a softening point of at least 150° C. and a central part comprising optically anisotropic pitch having a mesophase content of at least 95% by volume.

3. The pitch fiber according to claim 2, wherein the central part further comprises optically isotropic pitch.

* * * * *